US007334704B1

(12) United States Patent
Bynum

(10) Patent No.: US 7,334,704 B1
(45) Date of Patent: Feb. 26, 2008

(54) APPARATUS FOR FLATTENING THE WALLS OF FLEXIBLE TUBES

(76) Inventor: William C Bynum, P.O. Box 3208, Midland, TX (US) 79702

( * ) Notice: Subject to any disclaimer, the term of this patent is extended or adjusted under 35 U.S.C. 154(b) by 412 days.

(21) Appl. No.: 11/042,222

(22) Filed: Jan. 25, 2005

(51) Int. Cl.
*B65D 35/28* (2006.01)

(52) U.S. Cl. ..... 222/97; 222/101; 222/103

(58) Field of Classification Search ..... 222/97, 222/101–103
See application file for complete search history.

(56) References Cited

U.S. PATENT DOCUMENTS

| | | | | |
|---|---|---|---|---|
| 1,352,425 | A | 9/1920 | Boye | |
| 1,514,018 | A | 11/1924 | Sharpe | |
| 1,556,437 | A | 10/1925 | Granger | |
| 1,854,147 | A | 4/1932 | Guenther | |
| 1,894,936 | A * | 1/1933 | Austin | 222/97 |
| 1,904,050 | A | 4/1933 | Jaedike | |
| 2,545,342 | A | 3/1951 | Choquette | |
| 2,643,795 | A | 6/1953 | Teal | |
| 2,686,614 | A | 8/1954 | Geressy et al. | |
| 2,936,006 | A | 5/1960 | Henley | |
| 4,624,394 | A | 11/1986 | Ushiro | |
| D301,423 | S | 6/1989 | Waltel, Jr. | |
| 4,850,971 | A | 7/1989 | Colvin | |
| 4,976,380 | A | 12/1990 | von Schuckmann | |
| D313,914 | S | 1/1991 | Tribbey | |
| 5,102,014 | A | 4/1992 | Yanagisawa et al. | |
| 5,167,348 | A | 12/1992 | Okami et al. | |
| 5,178,301 | A | 1/1993 | McGanty | |
| 5,222,629 | A | 6/1993 | Tal | |
| 5,263,610 | A | 11/1993 | Okamura et al. | |
| 5,277,332 | A | 1/1994 | Rogers | |
| D351,521 | S | 10/1994 | Knight, III | |
| D360,326 | S | 7/1995 | Fairbanks | |
| D363,629 | S | 10/1995 | Bost | |
| 5,501,369 | A | 3/1996 | Tal | |
| 5,511,696 | A | 4/1996 | Gustafson | |
| 5,782,385 | A | 7/1998 | Soon | |
| 5,868,282 | A | 2/1999 | Imhoff | |
| 5,875,929 | A | 3/1999 | Nguyen | |
| 5,884,812 | A | 3/1999 | Stawowski | |
| 5,960,994 | A | 10/1999 | Liberatore | |
| 2006/0138167 | A1 * | 6/2006 | McMahon et al. | 222/100 |

* cited by examiner

*Primary Examiner*—Philippe Derakshani
(74) *Attorney, Agent, or Firm*—Howison & Arnott, L.L.P.

(57) ABSTRACT

An apparatus for flattening a flexible tube sidewall comprises a frame, a gripping roller and a handle. The frame includes a central portion extending transversely between first and second end walls. A first brake element is formed on an inner face of one wall. The roller is rotatably mounted to the walls and includes first and second ends and a cylindrical surface disposed parallel to the frame central portion to define a transverse slot. The roller end adjacent to the first brake element includes a second brake element that is engageable therewith to resist relative rotation between the roller and frame. The handle extends from the roller through the end wall for manually rotating the roller relative to the frame and drawing the tube through the slot. The brake elements cooperate to resist retrogressive movement of the tube through the slot when the handle is released.

19 Claims, 5 Drawing Sheets

APPARATUS FOR FLATTENING THE WALLS OF FLEXIBLE TUBES

TECHNICAL FIELD OF THE INVENTION

The current invention relates generally to manually-operated apparatus for flattening the walls of flexible walled tubes (e.g., toothpaste tubes) as the contents are dispensed, and more particularly, to an apparatus having a gripping roller and braking elements to resists retrogressive movement of the tube after dispensing.

BACKGROUND OF THE INVENTION

Squeeze-tube containers, also known as flexible tubes or collapsible tubes, are widely used for packaging relatively viscous products, for example, toothpaste, ointments, pastes, gels, creams, glues, paints and greases. These flexible tubes generally have an integral, deformable wall configured at one end with a dispensing nozzle (typically fitted with a cap) and at the other end with a flattened seal. The contents of the tube are generally dispensed by removing the cap and then manually squeezing the tube walls until the desired amount of product flows from the nozzle. However, the direction of movement of product within the tube is actually random, i.e., the product simply moves away from the point at which the tube is currently being squeezed. Thus, while a relatively full flexible tube may easily be manipulated to expel the contents, as the tube empties, further manipulation of the walls may only serve to move the remaining product back and forth within the tube. The user must then "chase" the product by re-squeezing the tube again and again, a procedure which can prove vexing to most users. This often results in a significant amount of "stranded" product, i.e., unused product left within the tube when it is discarded by the user because it was too troublesome for the user to extract it. Obviously, such practices result in a waste of the user's time and money.

The problem of minimizing the amount of product "stranded" in flexible tubes has aggravated users for some time. Further, while "stranding" was recognized as a problem with old-style flexible tubes having ductile metal walls, it has become even more pronounced since the introduction of flexible tubes having relatively resilient plastic walls which tend to spring back into their original shape after being squeezed.

Many devices have been proposed to assist in the maintenance of flexible tubes as the contents are dispensed. Many of these devices, while innovative, nonetheless proved to be too expensive to produce, too complicated to use, and/or excessively large for widespread use. A need therefore exists, for an apparatus for maintaining/managing the walls of flexible tubes during dispensing of the contents which is compact, inexpensive to produce, and easy to use.

SUMMARY OF THE INVENTION

The present invention disclosed and claimed herein comprises, in one aspect thereof, an apparatus for progressively flattening the sidewall of an elongated flexible or collapsible tube to dispense the contents therefrom. The apparatus comprises a frame, a gripping roller and a handle. The frame includes a generally flat central portion extending transversely between first and second end walls. One of the first and second end walls includes a first brake element formed on an inner face thereof. The gripping roller is rotatably mounted to the first and second end walls with a first roller end adjacent to the first end wall, a second roller end adjacent to the second end wall and a cylindrical roller surface generally parallel to, but spaced apart from, the central portion to define a transverse slot. The one of the first and second roller ends adjacent to the first brake element includes a second brake element formed thereon. The second brake element is engageable with the first brake element to resist relative rotation between the roller and frame. The handle member extends axially from the second roller end through the second end wall for manually rotating the gripping roller relative to the frame, whereby the sidewall of the tube may be inserted through the transverse slot and engaged by the gripping roller, and the handle member may be manually rotated to draw the engaged tube progressively through the slot to reduce the width of the tube. The brake elements cooperate to resist retrogressive movement of the tube through the slot when the handle member is released.

The present invention disclosed and claimed herein comprises, in another aspect thereof, an apparatus for progressively flattening the sidewall of a tube to dispense the contents therefrom. The apparatus comprises a frame, a gripping roller and a handle member. The frame is generally U-shaped and includes a central portion extending transversely between first and second end walls. The frame has a predetermined compliance allowing the first and second end walls to move, upon the application of an outwardly directed force thereto, from a first configuration wherein the first and second end walls are spaced apart a first distance, into a second configuration wherein the first and second end walls are spaced apart a second distance, and upon removal of the outwardly directed force, urging the end walls to move back into the first configuration. One of the first and second end walls includes a first brake element formed on an inner face thereof. The gripping roller is rotatably mounted to the end walls with a first roller end adjacent to the first end wall, a second roller end adjacent to the second end wall and a cylindrical roller surface generally parallel to, but spaced apart from, the central portion to define a transverse slot. The roller end adjacent to the first brake element includes a second brake element formed thereon. The second brake element cooperates with the first brake element to produce a first, relatively high force resisting rotation of the gripping roller relative to the frame when the frame is in the first configuration. The handle member extends axially from the second roller end through the second end wall for manually rotating the gripping roller relative to the frame.

DETAILED DESCRIPTION OF THE INVENTION

The current invention is described below in greater detail with reference to ceratin preferred embodiments illustrated in the accompanying drawings.

Figure 1:
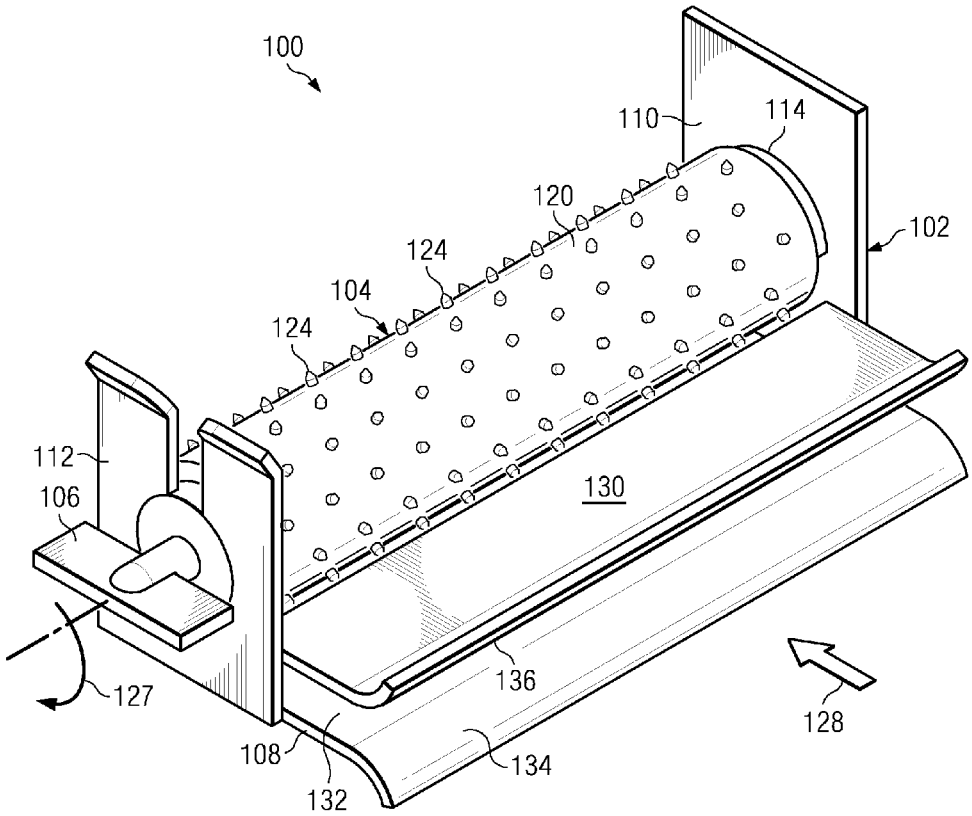
FIG. 1 is a perspective view of a tube squeezing apparatus in accordance with one embodiment.
Figure 2:
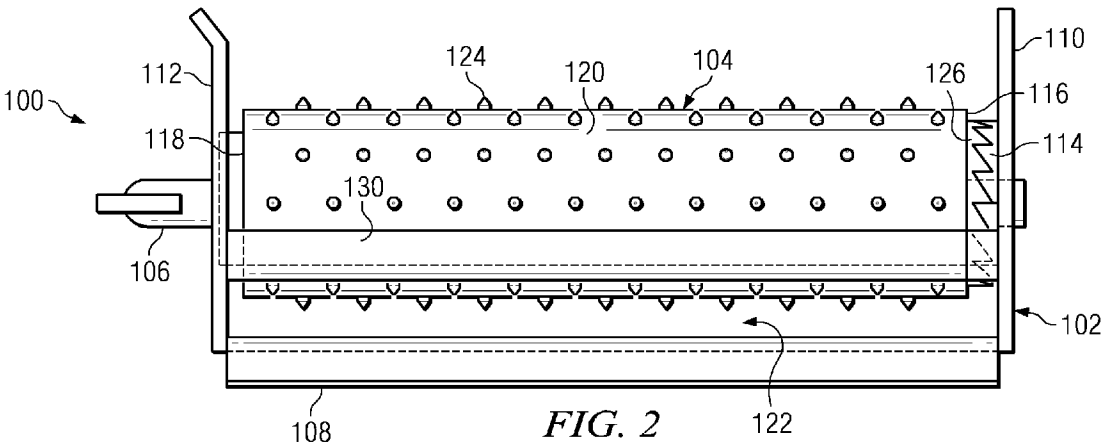
FIG. 2 is a front elevation view of the tube squeezing apparatus of FIG. 1.

Referring now to FIGS. 1 and 2, there is illustrated a tube squeezing apparatus in accordance with one embodiment of the current invention. Tube squeezing apparatus 100 includes a frame 102, a gripping roller 104 and a handle member 106. The frame 102 includes a generally flat central portion 108 that extends transversely between first and second end walls 110 and 112, respectively. A first brake element 114 is formed on the inner face of one of the end walls 110, 112. In the embodiment shown, the first brake element 114 is formed on the inner face of first end wall 110, however, in other embodiments the first brake element may be formed on the inner face of the second end wall 112. It is preferred, although not required, that the frame be formed as a single, integrally formed component.

The gripping roller 104 is rotatably mounted to the first and second end walls 110, 112. The gripping roller 104 includes a first roller end 116 adjacent to the first end wall 110, a second roller end 118 adjacent to the second end wall 112 and a cylindrical roller surface 120 extending therebetween. The roller surface 120 is disposed generally parallel to, but spaced apart from, the central frame portion 108 to define a transverse slot 122 where the squeezing of the tube will take place. The cylindrical roller surface 120 is preferably provided with a plurality of gripping features 124 to provide a better grip on the tube being squeezed. In the embodiment shown, the gripping features 124 comprise a plurality of small rounded projections arranged across the roller surface 120, however, in other embodiments other types of grip enhancement may be used including knurling, raised or depressed lines, naturally resilient materials (e.g., rubber or soft plastic gripping surface) or an overall roughened surface (e.g., having a texture like sandpaper).

The roller end 116 or 118 adjacent to the first brake element 114 includes a second brake element 126 formed thereon which engages the first brake element so as to resist relative rotation between the roller 104 and the frame 102. In the embodiment illustrated, the second brake element 126 is formed on the first roller end 116 because the first brake element 114 is present on the first end wall 110. It will be apparent, however, that if the first brake element was formed on the second end wall 112, then of course the second brake element would be formed on the corresponding second roller end 118.

The handle member 106 extends axially from the second roller end 118 through an aperture in the second end wall 112 for manually rotating the gripping roller 104 relative to the frame 102. It is preferred, although not required, that the handle member 106 be permanently attached to the gripping roller 104. It is even more preferred that the handle member 106 and gripping roller 104 be jointly formed as a single, integrally forward component. During operation, the closed flattened end of a flexible tube (not shown) may be inserted through the transverse slot 122 until the sidewall of the tube is engaged by the gripping roller 104. The handle member 106 is then manually rotated in the direction indicated by arrow 127 to draw the engaged tube progressively through the slot 122 in the direction indicated by arrow 128, thereby reducing the width of the tube as it passes through the slot 122 and causing the tube walls to be collapsed and flattened.

It will be appreciated that flattening the walls of a tube with the squeezing apparatus 100 as just described can be used for actually dispensing the tube's contents, however, this is not the preferred mode of operation. Rather, it is preferred to dispense a portion of the tube's contents by manually squeezing the tube, followed thereafter by operating the handle of the apparatus to progressively flatten the walls of the partially dispensed tube to prevent the remaining contents from "returning" to the rear of the tube during subsequent squeezing. In this manner, the tube is kept in good order with a neatly flattened (and empty) rear portion on one side of the squeezing apparatus roller and a front portion on the other side of the roller holding all of the remaining contents for easy and complete dispensing.

The brake elements 114 and 118 cooperate to resist retrogressive movement of the tube through the slot 122 when the handle member 106 is released. The height of the transverse slot 122 is preferably selected such that the sidewalls of the flexible tube will be pushed into contact with one another as the tube is progressively drawn through the slot, thereby preventing the contents of the tube from moving back into the flattened portion of the tube when the user releases the handle member. Thus, the amount of product which is "stranded" within the tube is reduced or eliminated. Because of its compact size, the squeezing apparatus 100 can be left on the tube for storage, i.e., in position engaging the sidewalls of the tube in the transfer slot 122 between the gripping roller 104 and the central portion of the frame 108. This prevents the squeezer apparatus 100 from being misplaced, minimizes the movement of product in the tube during storage, and leaves the tube/tube-squeezer combination in a convenient, ready-to-dispense configuration.

In the embodiment shown in FIGS. 1 and 2, the squeezing apparatus 100 further comprises a generally flat guide plate 130 spaced apart from the frame central portion 108 to define therebetween a guide channel 132 that is generally aligned with the transverse slot 122 to facilitate loading and feeding of the flexible tube into the squeezer apparatus. It is preferred, although not required, that the forward edges 134 and 136 of the central portion 108 and guide plate 130, respectively, be curved or angled away from one another so that the guide channel 132 flares outward to facilitate receipt of the flexible tube.

Figure 3:
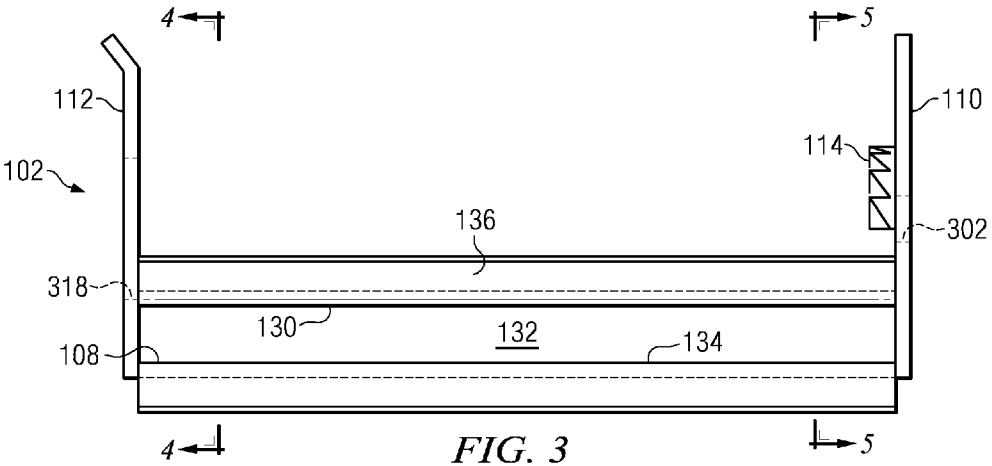
FIG. 3 is a front elevation view of the apparatus frame.
Figure 4:
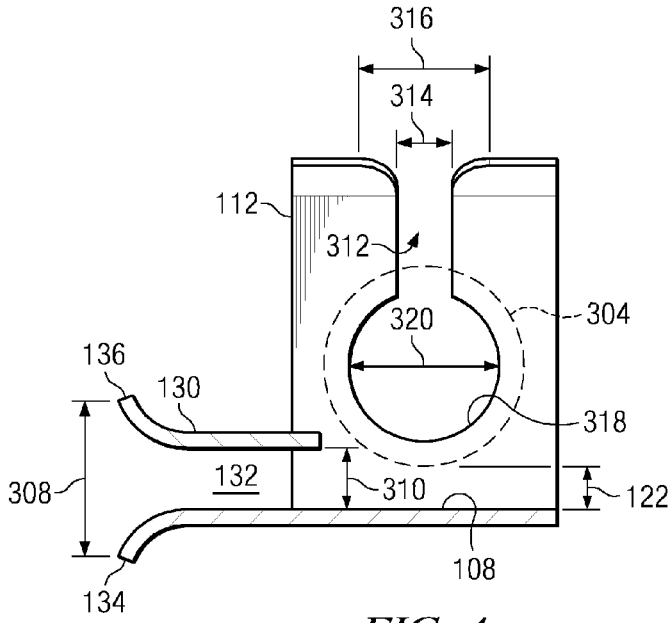
FIG. 4 is a cross-sectional view of the apparatus frame taken along line 4-4 of FIG. 3.
Figure 5:
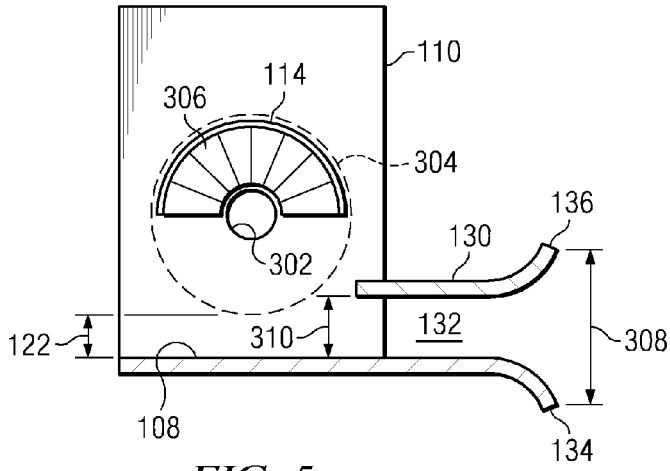
FIG. 5 is a cross-sectional view of the apparatus frame taken along line 5-5 of FIG. 3.

Referring now to FIGS. 3-5, there are illustrated a front view and two cross-sectional views of the frame 102. In this embodiment (as best seen in FIG. 5), the first end wall 110 includes an aperture 302 for mounting one end of the gripping roller 104 (the gripping roller is not shown in FIGS. 3-5, however, the position of the outer surface of the roller is indicated in FIGS. 4 and 5 by a broken line designated with reference numeral 304). The first brake element 114 is disposed adjacent to the mounting aperture 302. In this embodiment, the first brake element 114 comprises a plurality of angled teeth 306 arrayed in a generally semi-circular arrangement about mounting aperture 302. This semi-circular array of teeth 306, which represents only one of many possible configurations for the first brake element 114, interacts with the second brake element 118 as will be further described below. Some of the other possible configurations for the first brake element 114 include: A full 360 degree array of teeth surrounding the mounting aperture 302; a plurality of non-contiguous teeth spaced apart around the mounting aperture; and even a single tooth 306 formed on the first end wall 110.

Referring still to FIG. 5, it can be seen that the guide channel 132 defined between the frame central portion 108 and the guide plate 130 includes an entrance slot 308 and an exit slot 310. The exit slot 310 is longitudinally in front of, and generally aligned with, the transverse slot 122 formed between the frame central portion 108 and the cylindrical roller surface 304.

The illustrated embodiment further includes (as best seen in FIG. 4) a handle-access slot 312 formed in the second end wall 112 and extending from an inner mouth 314 disposed at an interior portion of the second end wall to an outer mouth 316 disposed on a free edge of the second end wall. The handle access slot 312 allows the gripping roller to be selectively removed, or "demounted," from the first and second end walls 112, 114 of the frame 102 by moving the handle member 106 through the handle access slot past the free edge of the second end wall. Demounting the gripping roller 104 from the frame 102 allows for the convenient removal of flexible tubes from the squeezing apparatus 100 without requiring the tube to be moved retrogressively (i.e., in a direction opposite to that indicated by arrow 128 in FIG. 1) back through the apparatus. This feature is especially important when the first and second braking elements 114 and 118 cooperate to form a ratchet or other one-way mechanism intended to prevent retrogressive movement of the tube.

Referring still to FIG. 4, the second end wall 112 of the illustrated embodiment also includes a hub-receiving opening or aperture 318 formed at the inner mouth 314 of the handle access slot 312. The hub-receiving aperture 318 has a diameter, denoted by reference numeral 320, which is greater than the width of the access slot inner mouth 314, but smaller than the diameter of the cylindrical roller surface of the gripping roller (shown by broken line 304).

Figure 6:
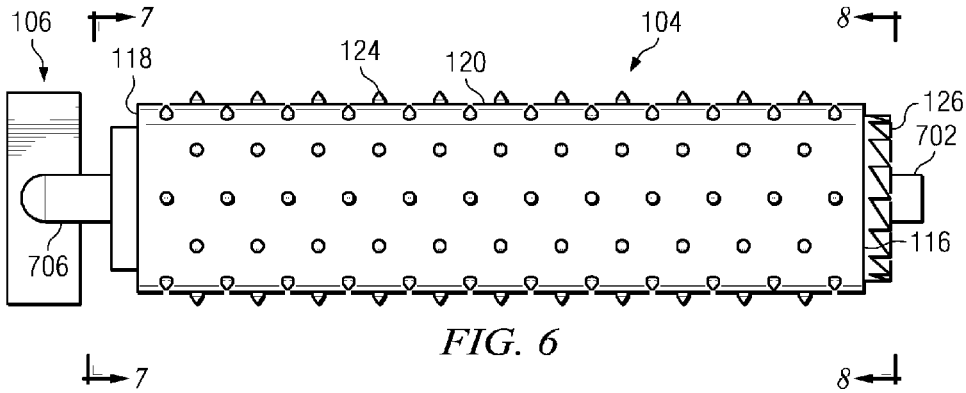
FIG. 6 is a front elevation view of the apparatus gripping roller.
Figure 7:
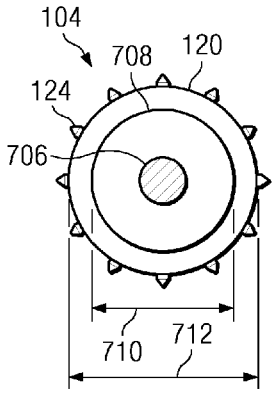
FIG. 7 is a cross-sectional end view of the gripping roller taken along line 7-7 of FIG. 6.
Figure 8:
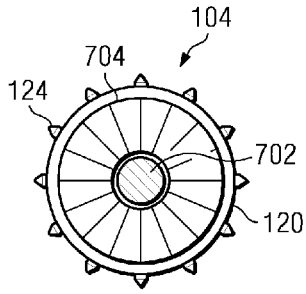
FIG. 8 is a cross-sectional end view of the gripping roller taken along line 8-8 of FIG. 6.

Referring now to FIGS. 6-8, there are illustrated a front view and two cross-sectional views of the gripping roller 104 and handle member 106. The gripping roller may include a stub shaft 702 extending from the first roller end 116 which is dimensioned to fit within the mounting aperture 302 to rotatably mount the first end of the gripping roller to the first end wall 110. As best seen in FIG. 8, the second brake element 126 is arrayed around the stub shaft 702 to allow it to cooperate with the first brake element 114 when the gripping roller 104 is mounted to the frame 102. In this embodiment, the second brake element 126 comprises a plurality of angled teeth 704 which are radially arranged around the stub shaft 702. The teeth 704 of the second brake element 126 cooperate with the teeth 306 of the first brake element 114 to enable relative rotation between the gripping roller 104 and the frame 102 in a first direction, e.g., the direction associated with progressive movement of the tube through the slot 122 (as denoted by arrow 128 in FIG. 1), but they do not allow relative rotation in the opposite direction, e.g., in the direction associated with retrogressive movement of the tube through the slot.

The handle member 106 includes a handle shaft 706 connected to the second roller end 118 of the gripping roller 104 to allow the roller to be manually rotated. In the embodiment shown, a cylindrical hub 708 also extends axially from the second roller end 118. The hub 708 has a diameter (denoted by reference number 710) which is less than the diameter (denoted by reference numeral 712) of the gripping roller 104, but greater than the width of the inner mouth 314 of the handle access slot 312 (see FIG. 4). Preferably, the diameter of the hub 708 is selected to allow the hub to rotate freely within the hub receiving opening 318 of the second end wall 112. It is preferred that the longitudinal (i.e., fore-and-aft) compliance of the portions of the second end wall 112 adjacent to the handle access slot 312 be insufficient to allow the cylindrical hub 708 to pass upwardly through the handle access slot. This configuration prevents the gripping roller 104 from being inadvertently demounted due to upward pressure exerted by the flexible tube as it is drawn into the slot 122 between the roller and central frame portion 108.

Figure 10:
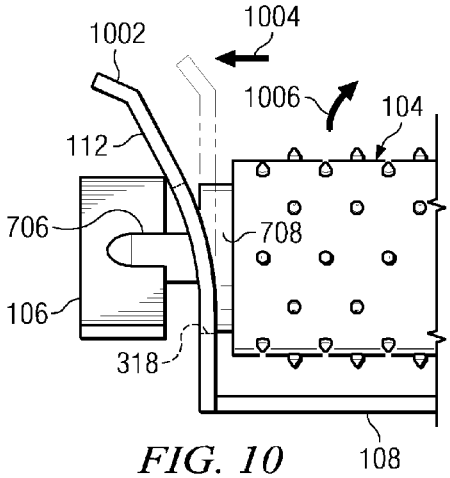
FIG. 10 is a partial front view of the tube squeezing apparatus illustrating the removal of the gripping roller from the frame.

While it is typically desirable that the gripping roller does not inadvertently move out of engagement with the frame 102 during use, it is nonetheless a convenient and useful feature of the current invention that the gripping roller can be diseng aged from the frame when the user so desires. Referring now to FIG. 10, the features of this embodiment allowing such selective removal are illustrated. In this embodiment, the transverse compliance of the second end wall 112 is sufficiently low to allow the upper end 1002 of the end wall to be moved from a first position (shown in broken line in FIG. 10), wherein the hub 708 of the roller 104 is engaged by the hub receiving opening 318, into a second position (shown in solid line in FIG. 10), wherein the upper portion of the hub is disengaged from the hub receiving opening, by the application of a manual force applied in the direction indicated as shown by arrow 1004. Once the upper portion of hub 708 is out of engagement with the hub receiving opening 318 of the sidewall 112, the shaft portion 706 of the handle member 106 may be moved upward through the handle access slot 312, allowing the gripping roller 104 to move upward (as indicated by arrow 1006) to facilitate its removal from the frame 102. After removing the gripping roller 104 from the frame 102, the flexible tube may be removed from the apparatus and discarded. The gripping roller 104 is then remounted to the frame 102 by reversing the steps just described. For added convenience to the user, the upper end 1002 of the second end wall 112 may be angled or flared transversely outward to facilitate receipt of the gripping roller. In addition, the outer mouth 316 of the handle access slot may be longitudinally flared (as shown in FIG. 4) to facilitate guidance of the handle shaft when reinstalling the gripping roller to the frame.

Figure 9:
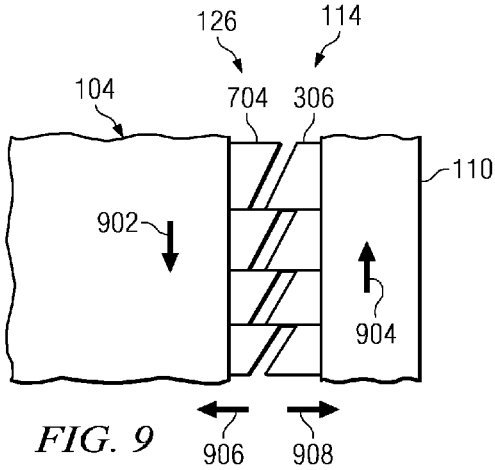
FIG. 9 is an enlarged view, with portions broken away, of the interface between the first and second braking elements illustrating their operation.

Referring now to FIG. 9, there is illustrated an enlarged view of the first and second brake elements of this embodiment. As previously described, in this embodiment the first brake element 114 comprises a first plurality of angled teeth 306 and the second brake element 126 comprises a second plurality of angled teeth 704. It will be understood that progressive motion of the flexible tube through the squeezer apparatus is accomplished by rotating the gripping roller 104 relative to the frame 102 (represented in FIG. 9 by first sidewall 110) in the relative direction indicated by arrows 902 and 904. It will then be appreciated that the teeth 306 of the first brake element form a sawtooth configuration with one edge (i.e., the back edge) being substantially perpendicular to the direction of this relative motion. It will further be appreciated that the teeth 704 of the second brake element have a sawtooth profile which is substantially complimentary to that of the first brake element. In other words, relative motion between the gripping roller 104 and the frame 110 in the progressive direction represented by arrows 902 and 904 will cause the teeth to contact one another along their front surface, which is at an acute angle to the direction of relative motion. This contact produces a force vector which can be broken into two components, in particular, a first force vector that is parallel to the direction of relative movement and directed to oppose the relative movement, and a second force vector that is perpendicular to the direction of relative movement and directed to urge the roller and frame to move apart from one another in the direction indicated by arrows 906 and 908. If the frame 102 of the apparatus has sufficient transverse compliance, then the second force component will cause transverse relative motion (i.e., in the direction indicated by arrows 906 and 908) that will continue until the teeth 304 and 706 momentarily disengage, increment forward by one tooth distance, and then re-engage. In contrast, if the gripping roller 104 and frame 102 attempt to move in the retrogressive direction, i.e., in the direction opposite to that shown by arrows 902 and 904, then the teeth 306 and 704 will contact one another along the back side of the teeth along a line which is substantially perpendicular to their relative motion. The force vector components produced by this contact will be substantially all directed to resist the relative rotational motion indicated by arrows 902 and 904, with little or no force component produced in the transverse direction indicated by arrows 906 and 908. It will thus be appreciated that the brake mechanism represented by the cooperation of the first and second brake elements 114 and 126 will produce much greater resistance to retrogressive relative rotation than it will to progressive relative rotation. The amount of force required to achieve such relative rotation can be adjusted by changing the transverse compliance of the frame 102, e.g., by changing materials having different compliances or by change the dimensions of the frame members.

As previously described, it is preferred, although not required, that the frame 102 be produced as a one piece integral component so as to eliminate the need for assembly during manufacture. Similarly, it is preferred, although not required, that the gripping roller 104 and handle member 106 be produced as a one piece integrally formed component. While the components of the apparatus 100 can be formed from practically any material, including wood, metal or ceramic, it is contemplated that polymer materials of the thermosetting or thermoplastic will be suitable for many applications. Suitable polymer materials are believed to include nylon, styrene, ABS, and polycarbonates. Natural or synthetic rubber materials of various durometer hardness may also be used. Where polymer materials are used, it is convenient and cost effective to produce the components by injection molding processes. Thus, in a preferred embodiment, the entire tube squeezer apparatus 100 would be manufactured as two components, a one piece injection molded polymer frame and a one piece injection molded combination gripping roller and handle member.

Figure 11:
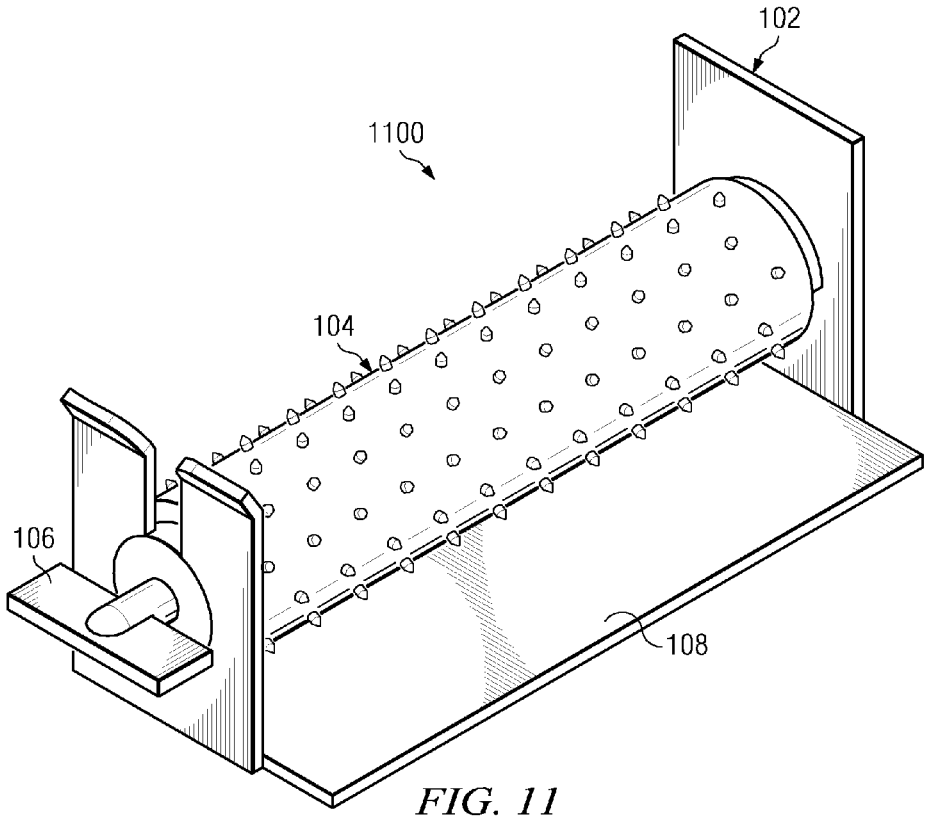
FIG. 11 is a perspective view of a tube squeezing apparatus in accordance with another embodiment.

Referring now to FIG. 11, there is illustrated a tube squeezing apparatus in accordance with another embodiment. Tube squeezer 1100 comprises a frame 102, gripping roller 104 and handle member 106 which, in most respects are substantially identical to those described for the previous embodiment. In this embodiment, however, the configuration of the frame 102 has been simplified to eliminate any outward curves or flares, and the guide plate which was present in the previous embodiment has been completely eliminated. The frame 102 of this embodiment, has a simplified configuration requiring simplified, less expensive tooling, especially if injection molding processes are to be used for manufacture. In addition, the simplified configuration may produce savings and material use and production costs.

While the invention has been shown or described in a variety of its forms, it should be apparent to those skilled in the art that it is not limited to these embodiments, but is susceptible to various changes without departing from the scope of the invention.

What is claimed is:

1. An apparatus for progressively flattening the sidewall of an elongated flexible or collapsible tube, the apparatus comprising:

a frame including a generally flat central portion extending transversely between first and second end walls, one of the first and second end walls including a first brake element formed on an inner face thereof;

a gripping roller rotatably mounted to the first and second end walls with a first roller end adjacent to the first end wall and a second roller end adjacent to the second end wall and a cylindrical roller surface generally parallel to, but spaced apart from, the central portion to define a transverse slot, the one of the first and second roller ends adjacent to the first brake element including a second brake element formed thereon engageable with the first brake element to resist relative rotation between the roller and frame;

a handle member extending axially from the second roller end through the second end wall for manually rotating the gripping roller relative to the frame, whereby the sidewall of the tube may be inserted through the transverse slot and engaged by the gripping roller and the handle member may be manually rotated to draw the engaged tube progressively through the slot to reduce the width of the tube and the brake elements will cooperate to resist retrogressive movement of the tube through the slot when the handle member is released; and a handle-access slot formed in the second end wall and extending from an inner mouth disposed at an interior portion of the second end wall to an outer mouth disposed on a free edge of the second end wall whereby the gripping roller is selectively demountable from the first and second end walls by moving the handle member through the handle-access slot past a free edge of the second end wall to facilitate insertion and removal of the tube from the apparatus.

2. An apparatus in accordance with claim 1, further comprising:

a cylindrical hub formed on the second roller end and extending axially therefrom, the hub having a diameter that is less than the diameter of the cylindrical roller surface and greater than the width of the inner mouth of the handle-access slot; and a hub-receiving opening formed in the second end wall at the inner mouth of the handle-access slot, the hub-receiving opening having a diameter sufficient to receive therein the cylindrical hub but insufficient to receive therein the cylindrical roller surface.

3. An apparatus in accordance with claim 2, wherein the longitudinal compliance of the portions of the second end wall adjacent to the handle-access slot is insufficient to allow the cylindrical hub to pass through the handle-access slot, but the transverse compliance of the second end wall is sufficiently low to allow the second end wall to be manually moved away from the second roller end and out of engagement with the cylindrical hub whereby the handle member may pass through the handle-access slot to facilitate mounting and demounting of the gripping roller.

4. An apparatus in accordance with claim 1, further comprising a generally flat guide plate spaced apart from the frame central portion to define therebetween a guide channel having an entrance slot and an exit slot, the exit slot being longitudinally in front of, and generally aligned with, the transverse slot between the central portion and the cylindrical roller surface.

5. An apparatus in accordance with claim 4, wherein the entrance slot of the guide channel is flared outward with respect to the exit slot whereby receipt of the tube thereinto is facilitated.

6. An apparatus in accordance with claim 1, wherein:

the frame is a first one-piece, integrally formed component; and the gripping roller and the handle member are jointly formed as a second one-piece, integrally formed component.

7. An apparatus in accordance with claim 6, wherein the first component is formed of a first polymeric material and the second component is formed of a second polymeric material.

8. An apparatus in accordance with claim 6, wherein the first and the second component are manufactured by an injection molding process.

9. An apparatus in accordance with claim 1, wherein the first and second brake elements cooperate to enable relative rotation between the gripping roller and the frame in a first direction associated with progressive movement of the tube through the slot, but do not allow relative rotation in the opposite direction associated with retrogressive movement of the tube through the slot.

10. An apparatus for progressively flattening the sidewall of a tube, the apparatus comprising:

a generally U-shaped frame including a central portion extending transversely between first and second end walls;

the frame having a predetermined compliance allowing the first and second end walls to move, upon the application of an outwardly directed force thereto, from a first configuration wherein the first and second end walls are spaced apart a first distance into a second configuration wherein the first and second end walls are spaced apart a second distance, and upon removal of the outwardly directed force, urging the end walls to move back into the first configuration;

one of the first and second end walls including a first brake element formed on an inner face thereof;

a gripping roller rotatably mounted to the first and second end walls with a first roller end adjacent to the first end wall and a second roller end adjacent to the second end wall and a cylindrical roller surface generally parallel to, but spaced apart from, the central portion to define a transverse slot, the one of the first and second roller ends adjacent to the first brake element including a second brake element formed thereon;

the second brake element cooperating with the first brake element to produce a first, relatively high force resisting rotation of the gripping roller relative to the frame when the frame is in the first configuration; and a handle member extending axially from the second roller end through the second end wall for manually rotating the gripping roller relative to the frame.

11. An apparatus in accordance with claim 10, wherein the first and second brake elements further cooperate to produce a second, relatively low force resisting rotation of the gripping roller relative to the frame when the frame is in the second configuration.

12. An apparatus in accordance with claim 11, wherein the first and second brake elements further cooperate to produce, upon rotation of the gripping roller in a first direction relative to the frame, an intermittent outwardly directed force on the first and second end walls sufficient overcome the predetermined compliance of the frame and move the frame from the first configuration into the second configuration, whereby the gripping roller may be incrementally rotated using a force that is greater than the second, relatively low force, but less than the first, relatively high force.

13. An apparatus in accordance with claim 12, wherein the first and second brake elements together constitute a ratchet mechanism.

14. An apparatus in accordance with claim 12, wherein one of the first and second brake elements comprises a plurality of tooth members formed on the roller end and disposed in a radial pattern.

15. An apparatus in accordance with claim 14, wherein the tooth members have a sawtooth profile when viewed in the radial direction.

16. An apparatus in accordance with claim 12, wherein:

the frame is a first one-piece, integrally formed component; and the gripping roller and the handle member are jointly formed as a second one-piece, integrally formed component.

17. An apparatus in accordance with claim 16, wherein the first component is formed of a first polymeric material and the second component is formed of a second polymeric material.

18. An apparatus in accordance with claim 10, wherein the frame, including the first brake element, is a one-piece, injection molded component having a predetermined compliance allowing manual rotation of the gripping roller relative to the frame in a first direction.

19. An apparatus in accordance with claim 9, wherein the first and second brake elements together constitute a ratchet mechanism.

* * * * *